US006918861B2

(12) United States Patent
Liao et al.

(10) Patent No.: US 6,918,861 B2
(45) Date of Patent: Jul. 19, 2005

(54) EXERCISER HAVING ROTATABLE SEAT DEVICE

(76) Inventors: Chung Min Liao, P.O. Box 63-99, Taichung (TW), 406; Wen Wan Tsai, P.O. Box 63-99, Taichung (TW), 406

( * ) Notice: Subject to any disclaimer, the term of this patent is extended or adjusted under 35 U.S.C. 154(b) by 109 days.

(21) Appl. No.: 10/665,157

(22) Filed: Sep. 19, 2003

(65) Prior Publication Data

US 2005/0065004 A1 Mar. 24, 2005

(51) Int. Cl.[7] ..... A63B 69/16
(52) U.S. Cl. ..... 482/57; 482/51; 482/146; 482/147
(58) Field of Search ..... 482/95, 96, 120, 482/146–148, 51, 57, 52

(56) References Cited

U.S. PATENT DOCUMENTS 4,132,405 A 1/1979 Asher ..... 272/146
4,390,180 A * 6/1983 Simjian ..... 482/131
4,953,858 A 9/1990 Zelli ..... 272/146
5,433,690 A * 7/1995 Gilman ..... 482/146
5,906,562 A * 5/1999 Lin ..... 482/53
5,924,961 A * 7/1999 Kuo et al. ..... 482/52
6,149,552 A * 11/2000 Chen ..... 482/72
6,398,699 B1 * 6/2002 Yang ..... 482/142
2004/0097336 A1 * 5/2004 Chuang
2004/0097337 A1 * 5/2004 Chuang
2005/0043143 A1 * 2/2005 Chuang

* cited by examiner

*Primary Examiner*—Gregory L. Huson
*Assistant Examiner*—Tam Nguyen

(57) ABSTRACT

An exerciser includes a foot support disposed on a base to support feet of users, a handle rotatably attached to the base with a shaft, a pulley secured to the handle, and a seat rotatably supported on the pulley to rotatably support the users. A cable may be coupled between the pulley and the foot support, to selectively couple the foot support to the handle via the pulley. The foot support includes a lever pivotally secured on the base, and the cable includes two ends coupled to the ends of the lever with brackets. Each of the brackets includes an end panel having a passage to receive a tube of a barrel which includes a passageway to receive the ends of the cable.

14 Claims, 7 Drawing Sheets

EXERCISER HAVING ROTATABLE SEAT DEVICE

BACKGROUND OF THE INVENTION

1. Field of the Invention

The present invention relates to an exerciser, and more particularly to an exerciser having a rotatable seat device to rotatably support the users thereon.

2. Description of the Prior Art

Various kinds of typical exercisers have been developed and comprise a platform rotatably supported on a base, to rotatably support the users thereon. The platform is provided to standingly support the users only, and may not be used for allowing the users to sit thereon.

For example, U.S. Pat. No. 4,132,405 to Asher discloses one of the typical exercisers including a platform rotatably supported on a base, and the users may only stand on the platform, and may not sit on the platform. In addition, only a pair of cords are coupled to the base, such that the users may not safely use these kind of typical exercisers.

U.S. Pat. No. 4,953,858 to Zelli discloses another typical exerciser including a platform rotatably supported on a base, and the users may also only stand on the platform, and may not sit on the platform. A pair of ski poles are disposed on the base to support the users, such that the users may feel more safely to use suck kind of typical exercisers.

However, the typical exercisers do not provide a rotatable seat device to rotatably support the users thereon, and do not provide a foot support device to support the feet of the users.

The present invention has arisen to mitigate and/or obviate the afore-described disadvantages of the conventional exercisers.

SUMMARY OF THE INVENTION

The primary objective of the present invention is to provide an exerciser including a rotatable seat device to rotatably support the users thereon, and including a foot support device to support the feet of the users.

In accordance with one aspect of the invention, there is provided an exerciser comprising a base including a shaft extended therefrom, a foot support disposed on the base to support feet of users, a handle including a lower portion rotatably attached to the base with the shaft, a pulley secured to the lower portion of the handle and rotated in concert with the handle, and a seat rotatably supported on the pulley to rotatably support the users.

A cable may further be provided and coupled between the pulley and the foot support, to selectively couple the foot support to the handle via the pulley. The pulley includes an outer peripheral recess formed therein to receive the cable, and includes a lock notch formed therein and communicating with the peripheral recess of the pulley, the cable includes a stop secured thereon and engaged in the lock notch of the pulley, to anchor the cable to the pulley, and to prevent the cable from sliding relative to the pulley.

The cable includes two ends for coupling to the foot support. The foot support includes a lever pivotally secured on the base and having two ends coupled to the ends of the cable with brackets.

Each of the brackets includes a first end attached to the lever, and a second end having a panel and having a passage formed in the panel, and a barrel having a tube engaged through the passage of the panel of the brackets, and each of the barrels includes a passageway formed therein to receive the ends of the cable respectively.

Each of the barrels includes an opening communicating with the passageway thereof, to receive at least one fastener which is secured to the ends of the cable and engaged in the opening of the bracket, to secure the ends of the cable to the brackets respectively, and thus to couple the ends of the lever of the foot support to the pulley. Each of the tubes of the barrels is threaded with a lock nut to secure the barrels to the brackets respectively.

A locking device may further be provided for selectively locking the handle to the base, and includes a board secured to the handle, and a latch selectively engaged through the board and engaged with the base, to selectively lock the board and the handle to the base, and to prevent the board and the handle from being rotated relative to the base.

The base includes a plate secured thereon, and a ball bearing disposed between the board and the plate to rotatably support the board of the handle on the plate. The handle includes a lower leg, and the pulley is secured to the leg of the handle.

A ball bearing may further be provided and disposed between the seat and the pulley to rotatably support the seat on the pulley. The ball bearing includes a disc disposed between the seat and the pulley and having a plurality balls engaged between the seat and the pulley, to rotatably support the seat on the pulley.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
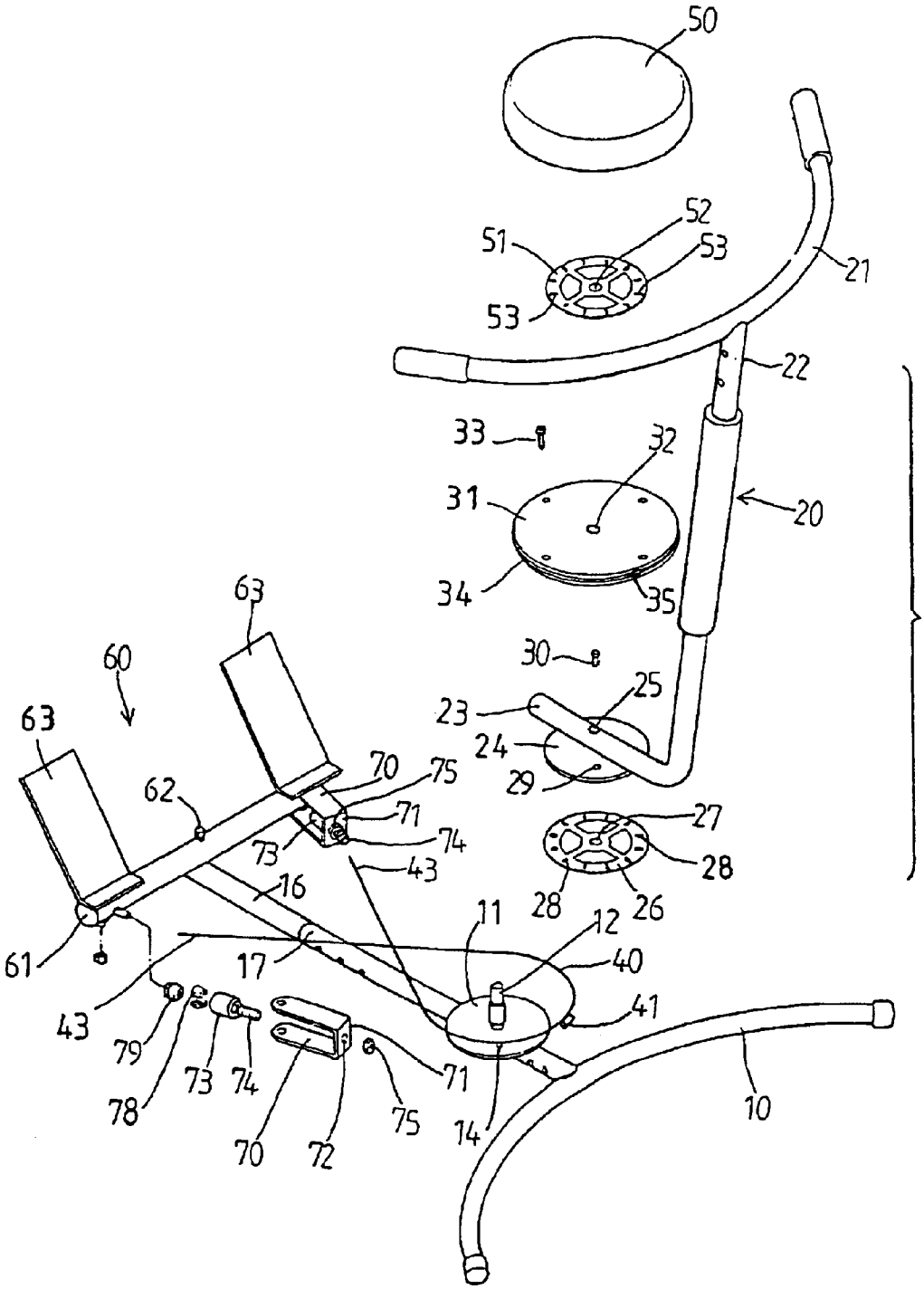
FIG. 1 is an exploded view of an exerciser.
Figure 2:
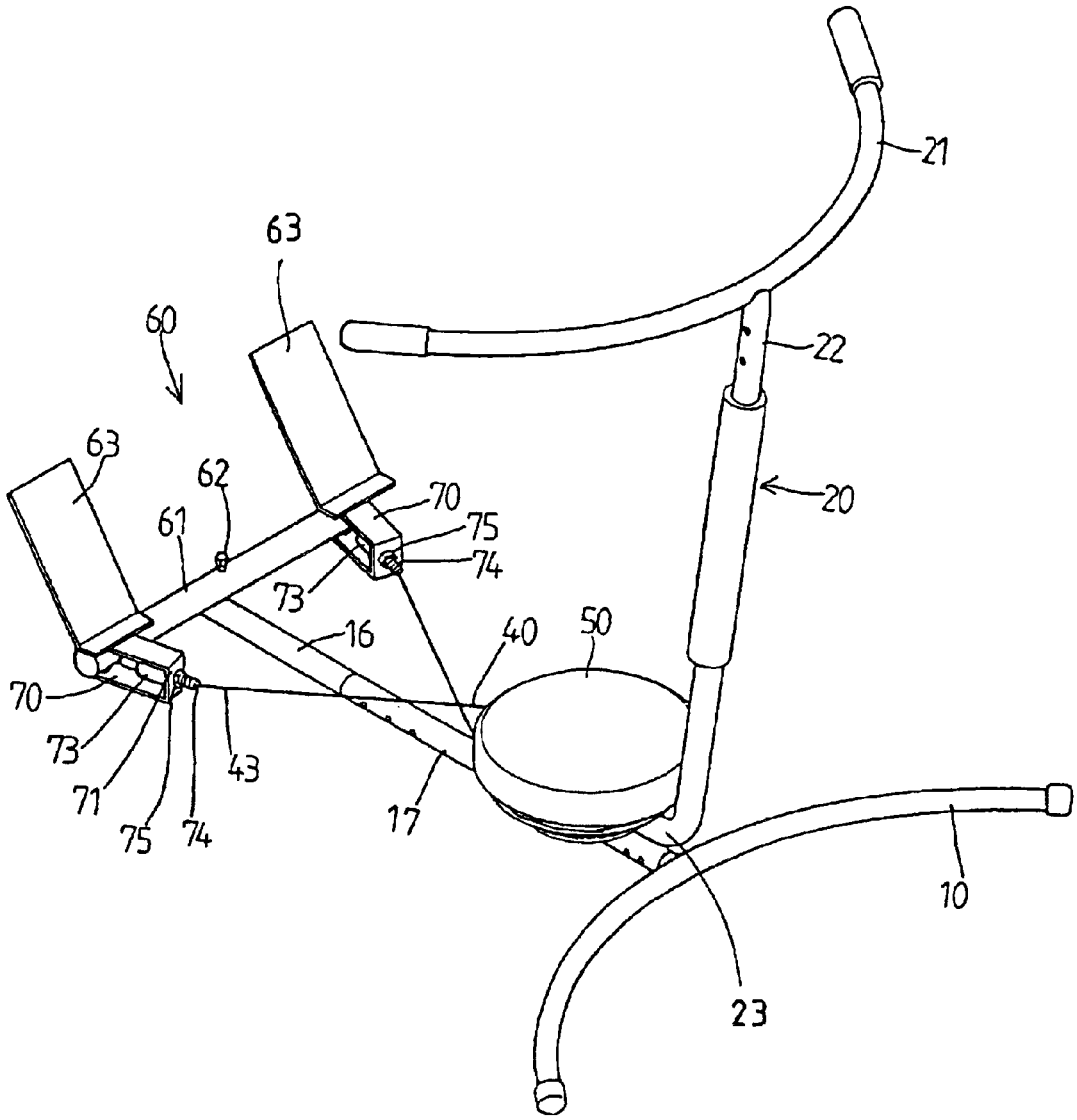
FIG. 2 is a perspective view of the exerciser.
Figure 3:
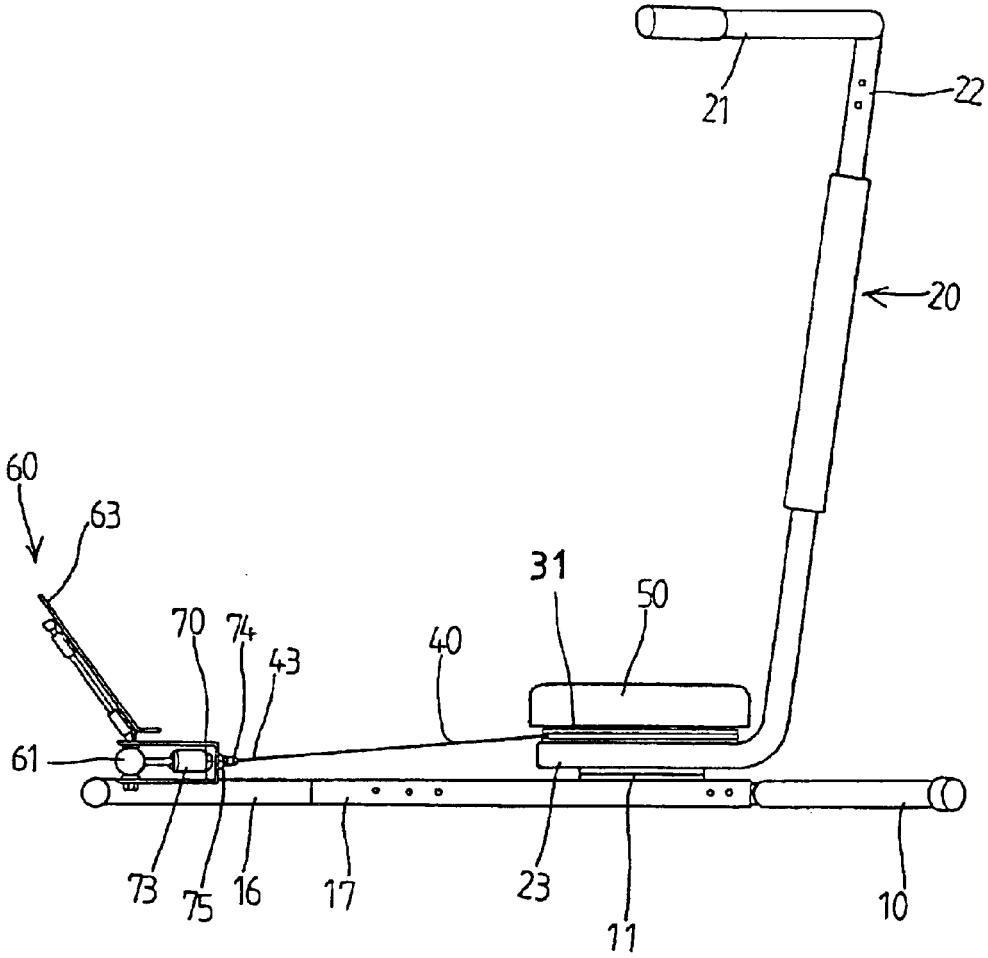
FIG. 3 is a side plan view of the exerciser.

Referring to the drawings, and initially to FIGS. 1–3, an exerciser comprises a base 10 including a plate 11 secured thereon, and a shaft 12 extended upwardly from the base 10, such as extended upwardly from the plate 11 of the base 10. The plate 11 includes a lock hole 14 formed therein.

A handle 20 includes a hand grip 21 provided on top thereof and supported thereon with such as a stem 22 which may be adjusted up and down relative to the handle 20 with a typical adjustable configuration (not shown). The handle 20 includes a leg 23 provided on the bottom thereof, a board 24 secured to the leg 23 or the bottom of the handle 20 and having an orifice 25 formed through the board 24 and the leg 23 of the handle 20.

The shaft 12 of the base 10 is rotatably engaged through the orifice 25 of the board 24 and the leg 23 of the handle 20, to rotatably secure the handle 20 on top of the base 10. A disc 26 includes a bore 27 formed therein to rotatably receive the shaft 12 of the base 10, and the disc 26 includes a number of balls 28 provided therein and engaged between the plate 11 and the board 24, to form as a bearing device to stably and rotatably support the board 24 and the handle 20 on top of the base 10.

The board 24 includes an aperture 29 formed therein, to selectively receive a latch 30 therein. The latch 30 may also be selectively engaged through the lock hole 14 of the plate 11, to selectively lock the board 24 to the plate 11, and thus to prevent the board 24 and thus the handle 20 from being rotated relative to the plate 11 of the base 10 when required.

A pulley 31 includes a bore 32 formed therein to receive the shaft 12 of the base 10, and the pulley 31 may be secured to the leg 23 or the board 24 with such as fasteners 33, to allow the pulley 31 to be rotated in concert with the handle 20 and the board 24. The pulley 31 includes a peripheral recess 34 formed in the outer peripheral portion thereof to receive a wire or cable 40; i.e., the cable 40 may be partially engaged in the peripheral recess 34 of the pulley 31.

The pulley 31 further includes a lock notch 35 formed therein (FIG. 1) and communicating with the peripheral recess 34 thereof, and the cable 40 includes a stop 41 secured thereon and engaged in the lock notch 35 of the pulley 31, to position or to anchor the cable 40 to the pulley 31, and to prevent the cable 40 from sliding relative to the pulley 31.

A seat 50 is rotatably attached onto the shaft 12 of the base 10. Another disc 51 includes a bore 52 formed therein to rotatably receive the shaft 12 of the base 10, and the disc 52 includes a number of balls 53 provided therein and engaged between the seat 50 and the pulley 31, to form as a bearing device to stably and rotatably support the seat 50 on top of the pulley 31.

Figure 6:
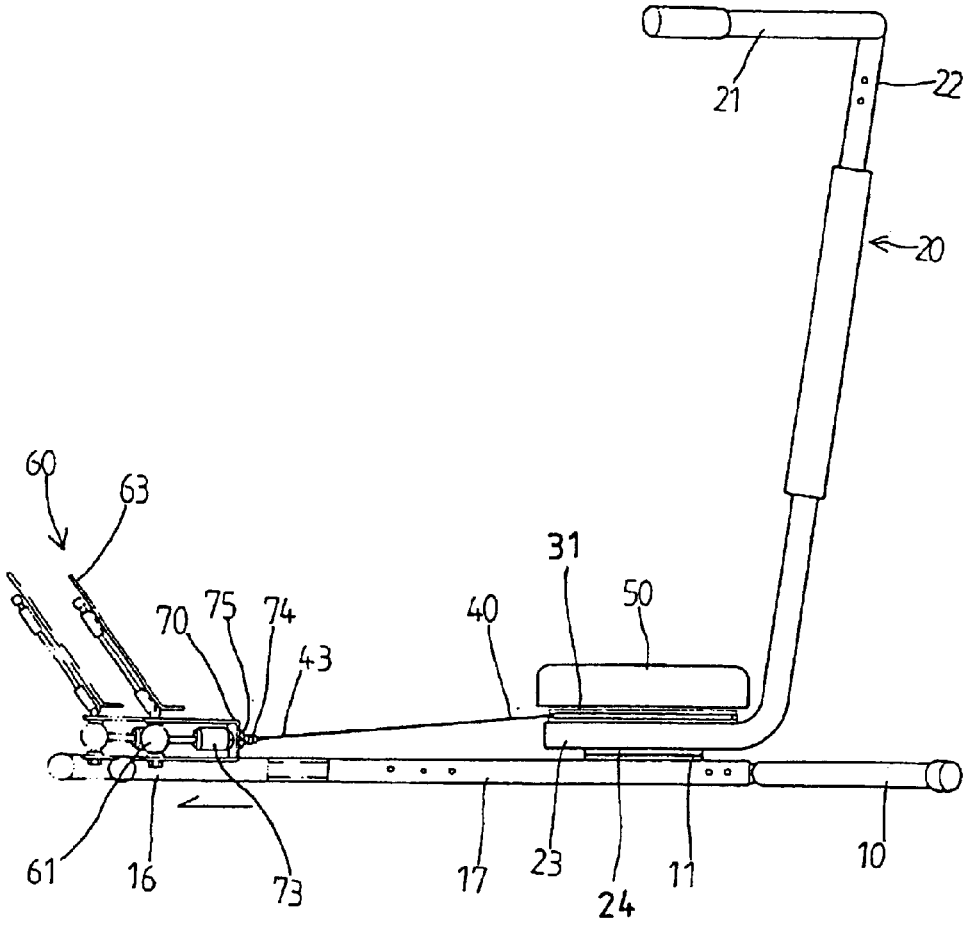
FIG. 6 is a side plan view similar to FIG. 3, illustrating the adjustment of the foot support for the exerciser.
Figure 7:
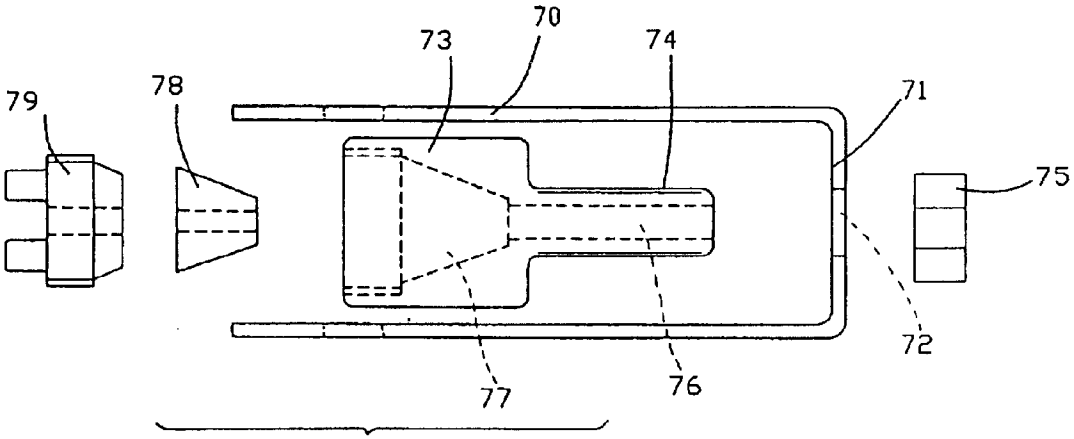
FIG. 7 is a partial plan schematic view of the exerciser, illustrating the coupling of the foot support to the seat device.
Figure 8:
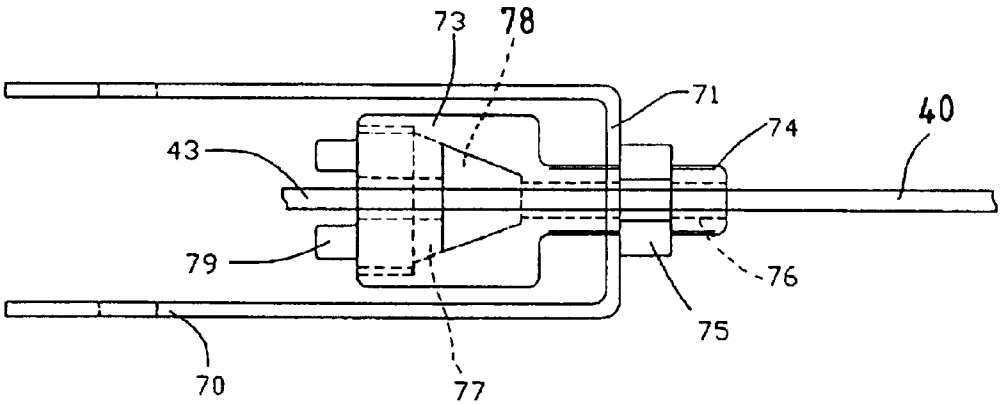
FIG. 8 is a partial plan and exploded view showing the coupling structure of the foot support to the seat device of the exerciser as shown in FIG. 7.

A foot support 60 is further provided and attached to the front portion of the base 10 to support the feet of the users. For example, the base 10 includes a conduit 16 adjustably secured to a front pole 17 thereof, to support the foot support 60 thereon, and to allow the conduit 16 and the foot support 60 to be adjusted relative to the front pole 17 of the base 10 (FIG. 6).

The foot support 60 includes a lever 61 having a middle portion rotatably or pivotally secured to the conduit 16 of the base 10 with a pivot axle 62, and includes a pair of foot pedals 63 disposed or attached to the lever 61, to support the feet of the users. The foot support 60 is coupled to the cable 40 and thus to be coupled to the pulley 31 or the seat 50 (FIGS. 2–6).

As shown in FIGS. 1, 2 and 7–8, two brackets 70 each includes one end attached to the lever 61, and an end panel 71 provided on the other end thereof. Each of the end panels 71 of the brackets 70 includes a passage 72 formed therein. A barrel 73 includes a threaded tube 74 engaged through the passage 72 of each of the brackets 70, and threaded with a lock nut 75 which may secure the barrel 73 to the bracket 70 respectively.

Each of the barrels 73 includes a passageway 76 formed therein to receive the ends 43 of the cable 40, and an enlarged or wedge-shape opening 77 formed in one end thereof and communicating with the passageway 76 thereof. One or more, such as two wedges 78 (FIG. 1) are received in the wedge-shape opening 77 of the barrel 73 engaged onto the end 43 of the cable 40.

A fastener 79 is threaded to the barrel 73 and engaged with the wedges 78, to force the wedges 78 to move along the wedge-shape opening 77 of the bracket 70, and to force the wedges 78 to clamp and to secure the ends 43 of the cable 40 to the barrels 73 and thus to the brackets 70 respectively, and thus to adjustably couple the end portions of the lever 61 of the foot support 60 to the pulley 31 and the seat 50.

Figure 4:
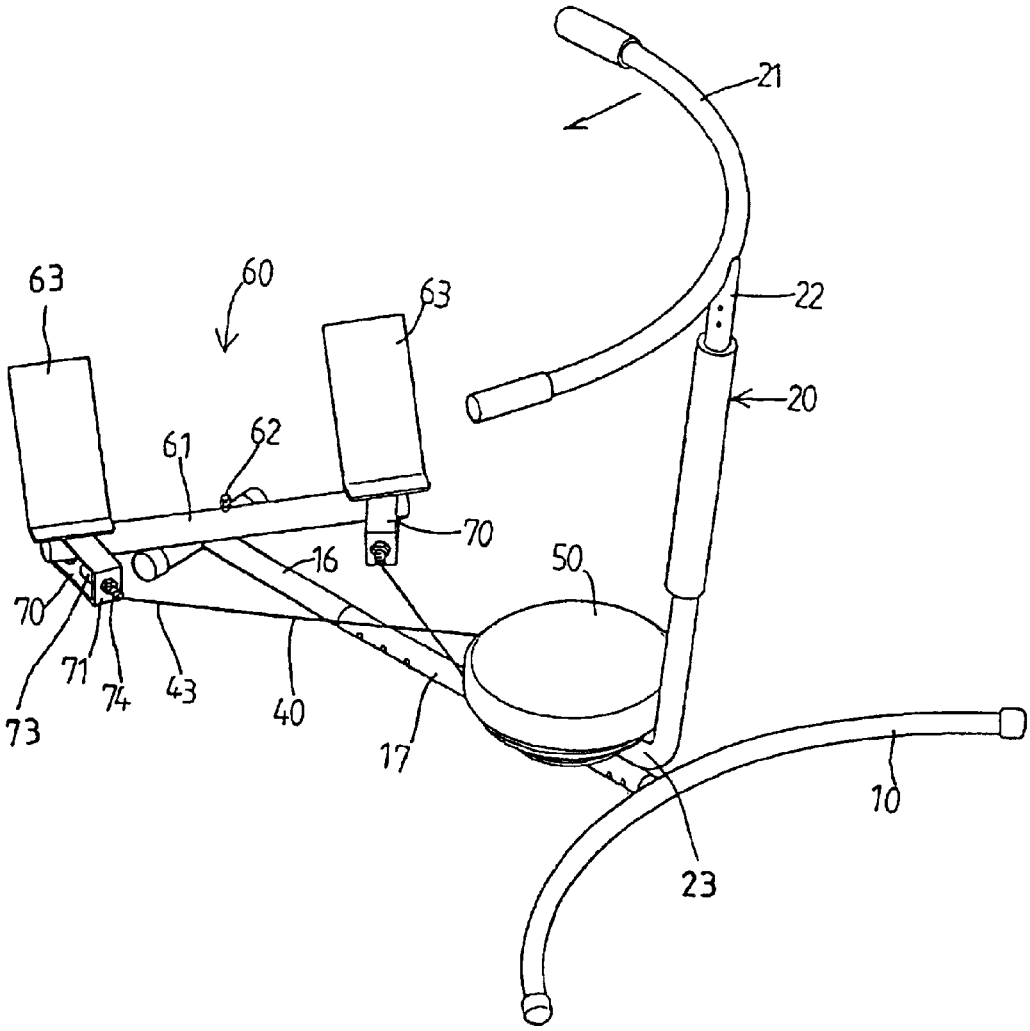
FIGS. 4, 5 are perspective views similar to FIG. 2, illustrating the operation of the exerciser.
Figure 5:
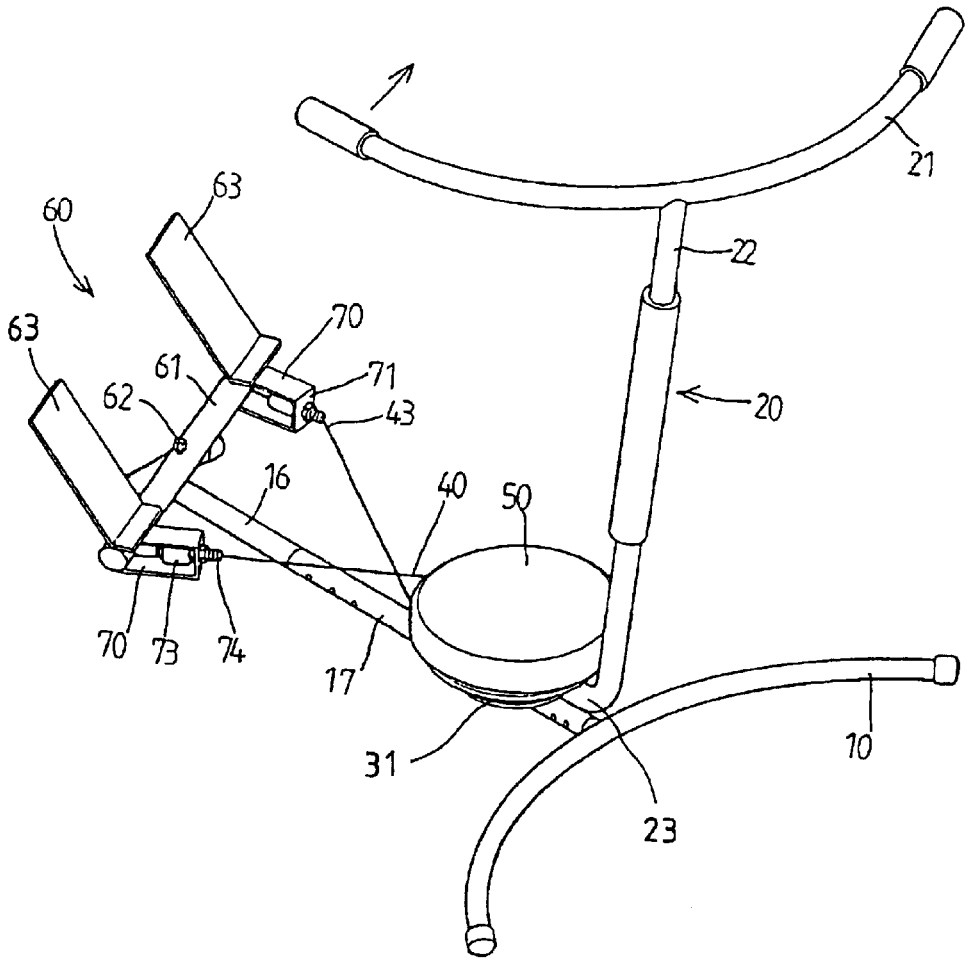

In operation, as shown in FIGS. 4 and 5, the users may be seated on the seat 50 and stepped onto the foot pedals 63 of the foot support 60 in order to step and rotate the foot support 60 and thus the handle 20 relative to the base 10. The users may also hold the hand grip 21 to rotate the handle 20 and thus the foot support 60 relative to the base 10.

It is to be noted that the cable 40 is arranged or disposed cross to each other as shown in FIGS. 2, 4, 5, to allow the foot support 60 to be rotated clockwise relative to the base 10 (FIG. 4) when the pulley 31 and the seat 50 rotate counterclockwise relative to the base 10. On the contrary, as shown in FIG. 5, the foot support 60 may be rotated counterclockwise relative to the base 10 when the pulley 31 and the seat 50 rotate clockwise relative to the base 10.

However, the cable 40 may also be arranged or coupled between the foot support 60 and the pulley 31 and the seat 50 without crossing to each other (not shown) to allow the foot support 60 to be rotated clockwise relative to the base 10 when the pulley 31 and the seat 50 rotate clockwise relative to the base 10, and to allow the foot support 60 to be rotated counterclockwise relative to the base 10 when the pulley 31 and the seat 50 rotate counterclockwise relative to the base 10.

When the latch 30 is selectively engaged through the lock hole 14 of the plate 11, to selectively lock the board 24 to the plate 11, the board 24 and thus the handle 20 may be prevented from being rotated relative to the plate 11 of the base 10. At this time, the seat 50 may also be rotated relative to the pulley 31 by the ball bearing device formed by the balls 53 of the disc 51.

The foot support 60 may also be solidly secured to the base 10 with the axle 62, and the ends of the cable 40 may be disengaged from the brackets 70 by releasing the fasteners 78, 79, to prevent the foot support 60 from being rotated by the handle 20 via the pulley 31 and the cable 40.

Accordingly, the exerciser includes a rotatable seat device to rotatably support the users thereon, and includes a foot support device to support the feet of the users.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

We claim:

1. An exerciser comprising:

a base including a shaft extended therefrom, a foot support disposed on said base to support feet of users, a handle including a lower portion rotatably attached to said base with said shaft, a pulley secured to said lower portion of said handle and rotated in concert with said handle, and a seat rotatably supported on said pulley to rotatably support the users.

2. The exerciser as claimed in claim 1 further comprising a cable coupled between said pulley and said foot support, to selectively couple said foot support to said handle via said pulley.

3. The exerciser as claimed in claim 2, wherein said pulley includes an outer peripheral recess formed therein to receive said cable, and includes a lock notch formed therein and communicating with said peripheral recess of said pulley, said cable includes a stop secured thereon and engaged in said lock notch of said pulley, to anchor said cable to said pulley, and to prevent said cable from sliding relative to said pulley.

4. The exerciser as claimed in claim 2, wherein said cable includes two ends for coupling to said foot support.

5. The exerciser as claimed in claim 4, wherein said foot support includes a lever pivotally secured on said base and having two ends coupled to said ends of said cable with brackets.

6. The exerciser as claimed in claim 5, wherein each of said brackets includes a first end attached to said lever, and a second end having a panel and having a passage formed in said panel, and a barrel having a tube engaged through said passage of said panel of each of said brackets, and each of said barrels includes a passageway formed therein to receive said ends of said cable respectively.

7. The exerciser as claimed in claim 6, wherein each of said barrels includes an opening formed therein and communicating with said passageway thereof, to receive at least one fastener therein, said at least one fastener is secured to said ends of said cable and engaged in said opening of said bracket, to secure said ends of said cable to said brackets respectively, and thus to couple said ends of said lever of said foot support to said pulley.

8. The exerciser as claimed in claim 6, wherein each of said tubes of said barrels is threaded with a lock nut to secure said barrels to said brackets respectively.

9. The exerciser as claimed in claim 1 further comprising means for selectively locking said handle to said base.

10. The exerciser as claimed in claim 9, wherein said locking means includes a board secured to said handle, and a latch selectively engaged through said board and engaged with said base, to selectively lock said board and said handle to said base, and to prevent said board and said handle from being rotated relative to said base.

11. The exerciser as claimed in claim 10, wherein said base includes a plate secured thereon, and a ball bearing disposed between said board and said plate to rotatably support said board of said handle on said plate.

12. The exerciser as claimed in claim 1, wherein said handle includes a lower leg, and said pulley is secured to said leg of said handle.

13. The exerciser as claimed in claim 1 further comprising a ball bearing disposed between said seat and said pulley to rotatably support said seat on said pulley.

14. The exerciser as claimed in claim 13, wherein said ball bearing includes a disc disposed between said seat and said pulley and having a plurality balls engaged between said seat and said pulley, to rotatably support said seat on said pulley.

* * * * *